US011833397B2

(12) United States Patent
Molinari

(10) Patent No.: US 11,833,397 B2
(45) Date of Patent: Dec. 5, 2023

(54) INFLATABLE SPORTS BALL WITH RESTRICTION STRUCTURE

(71) Applicant: NIKE, Inc., Beaverton, OR (US)

(72) Inventor: Arthur Parker Molinari, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 238 days.

(21) Appl. No.: 17/220,493

(22) Filed: Apr. 1, 2021

(65) Prior Publication Data

US 2021/0370143 A1 Dec. 2, 2021

Related U.S. Application Data

(60) Provisional application No. 63/030,279, filed on May 26, 2020.

(51) Int. Cl.
*A63B 41/08* (2006.01)
*A63B 41/02* (2006.01)

(52) U.S. Cl.
CPC ..... *A63B 41/08* (2013.01); *A63B 41/02* (2013.01)

(58) Field of Classification Search
CPC ... A63B 41/08; A63B 41/02; A63B 2041/005; A63B 41/00
See application file for complete search history.

(56) References Cited

U.S. PATENT DOCUMENTS 2,221,533 A 11/1940 Voit et al.
2,380,370 A * 7/1945 Smith, Jr. ..... F16K 15/202 473/610
2,623,747 A * 12/1952 Crowley ..... A63B 41/10 156/170
2,627,892 A * 2/1953 Fenton ..... A63B 45/00 156/170
2,653,818 A 9/1953 Tebbetts, Jr. et al.
2,688,488 A * 9/1954 Crowley ..... A63B 41/00 156/212
2,945,693 A * 7/1960 Way ..... A63B 39/00 156/170

(Continued)

FOREIGN PATENT DOCUMENTS

GB 301302 A * 12/1929
WO 2007033435 A1 3/2007

(Continued)

*Primary Examiner* — Steven B Wong
(74) *Attorney, Agent, or Firm* — Quinn IP Law

(57) ABSTRACT

An inflatable sports ball is provided. The inflatable sports ball having a bladder defining an exterior bladder surface and a bladder circumference. The inflatable sports ball may further comprise a cover disposed about the bladder, the cover comprising an outer cover layer and an intermediate structure. The intermediate structure is disposed between the outer cover layer and the bladder. The intermediate structure comprises a restriction structure. The restriction structure may comprise a plurality of overlapping strips. Each of the overlapping strips is interwoven with each of the other strips and wrapped about the bladder circumference. In this way, the restriction structure comprises a uniform number of radially-stacked layers of the overlapping strips over a substantial entirety of the exterior bladder surface between the exterior bladder surface and the outer cover layer.

17 Claims, 7 Drawing Sheets

(56) References Cited

U.S. PATENT DOCUMENTS 3,506,265 A 4/1970 Yugi
4,239,568 A 12/1980 Takazawa
4,415,154 A * 11/1983 Engelhardt ..... A63B 69/0097 473/456
4,462,590 A * 7/1984 Mitchell ..... A63B 41/08 273/DIG. 8
4,542,902 A * 9/1985 Massino ..... A63B 45/00 273/DIG. 20
4,570,931 A 2/1986 Martin
4,660,831 A * 4/1987 Kralik ..... A63B 41/00 473/603
4,856,781 A 8/1989 Shishido et al.
5,096,756 A * 3/1992 Walters ..... C08L 27/06 473/610
5,294,112 A * 3/1994 Smith ..... A63B 41/02 473/610
6,039,662 A 3/2000 Chan
6,194,501 B1 2/2001 Okada et al.
6,203,868 B1 3/2001 Bonk et al.
6,206,794 B1 3/2001 Chan
6,220,979 B1 4/2001 Chan
RE37,468 E 12/2001 Kennedy et al.
6,348,018 B1 2/2002 Ou
6,503,162 B1 1/2003 Shishido et al.
6,638,189 B2 * 10/2003 Chang ..... A63B 45/00 473/605
6,656,067 B2 12/2003 Ou
6,663,520 B2 12/2003 Ou Chen
6,685,585 B2 2/2004 Shishido et al.
6,971,965 B1 12/2005 Shishido
7,585,236 B2 9/2009 Krysiak
7,645,203 B2 1/2010 Tang et al.
7,699,726 B2 4/2010 Avis
7,785,219 B2 8/2010 Avis
7,892,120 B2 2/2011 Krysiak
7,909,715 B2 3/2011 Krysiak
8,021,252 B2 9/2011 Goedoen
8,033,936 B2 10/2011 Ou
8,182,379 B2 5/2012 Rapaport et al.
8,192,311 B2 * 6/2012 White ..... D04B 1/22 473/603
8,210,973 B2 7/2012 Rapaport et al.
8,251,846 B2 8/2012 Krysiak
8,262,519 B2 9/2012 Raynak et al.
8,388,476 B2 3/2013 Ou
8,460,136 B2 6/2013 Krysiak
8,579,743 B2 11/2013 Cohen et al.
8,597,144 B2 12/2013 Chang et al.
8,608,599 B2 12/2013 Raynak et al.
8,617,011 B2 12/2013 Berggren et al.
8,632,430 B2 1/2014 Avis et al.
8,672,784 B2 3/2014 Berggren et al.
8,684,870 B2 4/2014 Ito et al.
8,708,847 B2 4/2014 Berggren et al.
8,740,734 B2 6/2014 Krysiak
8,771,115 B2 7/2014 Berggren et al.
8,777,787 B2 7/2014 Raynak et al.
8,852,039 B2 10/2014 White et al.
8,926,459 B2 1/2015 Berggren et al.
8,974,329 B2 3/2015 Laliberty
8,974,330 B2 3/2015 Berggren et al.
9,017,192 B1 4/2015 Silva
9,089,744 B2 7/2015 Lo
9,211,446 B2 12/2015 Berggren
9,254,424 B2 2/2016 Berggren et al.
9,327,167 B2 5/2016 Raynak et al.
9,370,693 B2 6/2016 Berggren et al.
9,370,695 B2 6/2016 Chang et al.
9,682,286 B2 6/2017 Shishido et al.
D800,854 S * 10/2017 O'Malley ..... D21/713
9,814,941 B2 11/2017 Cohen et al.
9,833,957 B2 12/2017 Chen et al.
10,343,026 B2 7/2019 Berggren et al.
10,350,460 B2 7/2019 Berggren et al.
10,406,404 B2 9/2019 Bichler et al.
10,434,374 B2 10/2019 Berggren et al.
2002/0086749 A1 7/2002 Ou
2003/0228946 A1 12/2003 Chan
2004/0087396 A1 5/2004 Chan
2004/0144477 A1 7/2004 Taniguchi et al.
2006/0084536 A1 * 4/2006 Taniguchi ..... A63B 41/00 473/605
2008/0044635 A1 2/2008 O'Neill et al.
2008/0051233 A1 2/2008 Nesbitt et al.
2009/0325742 A1 12/2009 Krysiak
2010/0167850 A1 7/2010 Lin
2012/0277044 A1 11/2012 Berggren et al.
2012/0283055 A1 11/2012 Berggren et al.
2013/0005521 A1 1/2013 White et al.
2013/0059683 A1 3/2013 Krysiak et al.
2014/0106912 A1 4/2014 Cohen et al.
2014/0179468 A1 6/2014 Berggren et al.
2014/0182781 A1 7/2014 Berggren et al.
2014/0274498 A1 * 9/2014 Berggren ..... A63B 41/02 29/458
2015/0182809 A1 7/2015 Jones
2016/0346626 A1 12/2016 Nurnberg et al.
2017/0050089 A1 2/2017 Olivares Velasco
2017/0151470 A1 * 6/2017 Nürnberg ..... A63B 41/04

FOREIGN PATENT DOCUMENTS

WO 2012151281 A1 11/2012
WO 2013148946 A1 10/2013
WO 2018217443 A1 11/2018
WO 2020112624 A1 6/2020

* cited by examiner

INFLATABLE SPORTS BALL WITH RESTRICTION STRUCTURE

CROSS REFERENCE TO RELATED APPLICATIONS

This application claims the benefit of U.S. Provisional Application No. 63/030,279, filed May 26, 2020, which is hereby incorporated by reference in its entirety.

TECHNICAL FIELD

The disclosure relates to inflatable sports balls. More particularly, inflatable sports balls having a restriction structure.

BACKGROUND

A variety of inflatable sports balls, such as soccer balls, conventionally exhibit a layered structure that includes a casing, an intermediate structure, and a bladder. The casing forms an exterior portion of the sports ball and is generally formed from a plurality of durable and wear-resistant panels joined together along abutting edge areas (e.g., with stitching, adhesives, or bonding), i.e., via a seam. Designs such as decorative elements and holistic textural patterns may be applied to the exterior surface of the casing.

An intermediate structure forms a middle portion of the sports ball and is positioned between the casing and the bladder. Among other purposes, the intermediate structure may provide a softened feel to the sports ball, impart energy return, and restrict expansion of the bladder.

SUMMARY

An inflatable sports ball is provided. The inflatable sports ball comprises a bladder, an outer cover layer, and an intermediate structure. The bladder may define an exterior bladder surface, a bladder circumference, and a valve opening configured to receive a valve. The intermediate structure is disposed between the outer cover layer and the bladder. The intermediate structure comprises a restriction structure.

The restriction structure is configured to restrict the expansion of and maintains the shape of the bladder. The restriction structure is formed in a non-planar configuration and shaped to conform with the exterior bladder surface. More particularly, the restriction structure further comprises a plurality of overlapping strips wrapped about the bladder circumference. In this way, the restriction structure comprises a uniform number of radially-stacked layers of the overlapping strips over a substantial entirety of the exterior bladder surface.

DETAILED DESCRIPTION

Figure 1:
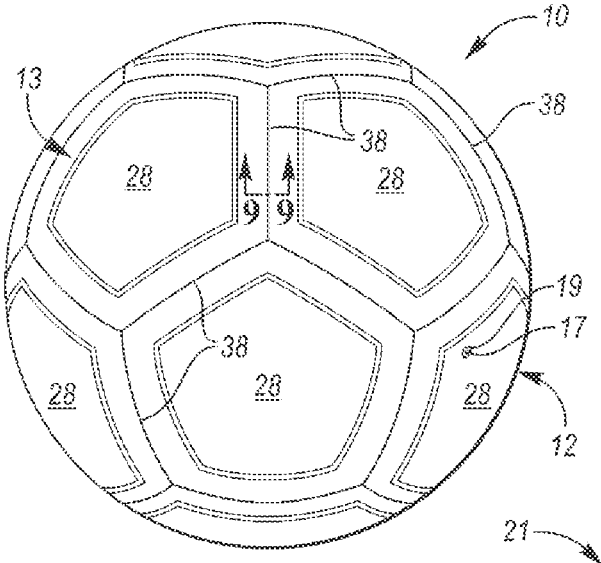
FIG. 1 is a schematic perspective view of an example inflatable sports ball.

While the present disclosure may be described with respect to specific applications or industries, those skilled in the art will recognize the broader applicability of the disclosure. Those having ordinary skill in the art will recognize that terms such as "above," "below," "upward," "downward," etc., are used descriptively of the figures, and do not represent limitations on the scope of the disclosure, as defined by the appended claims. Any numerical designations, such as "first" or "second" are illustrative only and are not intended to limit the scope of the disclosure in any way.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

The terms "a," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

The following discussion and accompanying figures disclose various sports ball configurations and methods relating to the manufacturing of the sport balls. Although the sports ball is depicted as a soccer ball in the associated figures, concepts associated with the configurations and methods may be applied to various types of inflatable sport balls, such as basketballs, footballs (for either American football or rugby), volleyballs, water polo balls, etc.

Referring to the drawings, wherein like reference numerals refer to like components throughout the several views, an inflatable sports ball 10 is provided. In a general sense, the sports ball 10 of the present disclosure includes a casing 12 disposed about an interior bladder 16. The casing 12 includes an outer cover layer 24 and an intermediate structure 14 disposed between the outer cover layer 24 and the interior bladder 16. The intermediate structure 14 includes a restriction structure 22 configured to restrict the expansion of and maintain the shape of the interior bladder 16, when the bladder 16 is inflated to a predetermined internal pressure. The restriction structure 22 comprises a plurality of overlapping strips 15 wrapped about a circumference 30 of the bladder 16. In this way, the restriction structure 22 comprises a uniform number of radially-stacked layers of the overlapping strips 15 over a substantial entirety of the exterior bladder surface 21 between the exterior bladder surface 21 and the outer cover layer 24.

The plurality of overlapping strips 15 is a beneficial configuration for the restriction structure 22, because such a configuration creates a uniform number of radially-stacked layers and/or a uniform thickness of the restriction structure 22 across a substantial entirety of the exterior bladder surface 21. Such a configuration of the restriction structure 22 also eliminates a need for an adhesive binder to secure the respective strips 15 in place on the bladder 16. Such consistency in the number of radially-stacked layers of the overlapping strips 15 across an entirety of the exterior bladder surface 21, as well as the absence of a heavy and/or bulky resin binder, promotes improved consistency in rebound characteristics, improved balance (reduced wobble), as well as improved touch properties of the sports ball 10.

Such a configuration of the restriction structure 22 also allows for consistency in manufacturing, as well as optimization of the dimensions, e.g., size, weight, and sphericity of the sports ball 10, which is particularly beneficial when the sports ball 10 is embodied as an inflatable soccer ball, as depicted in FIGS. 1-4, as high level, pro quality soccer balls shall be manufactured to at least the specifications set forth by Federation Internationale de Football Association (FIFA) for Size 5 FIFA Quality Pro level soccer balls Sports balls 10 governed by the Size 5 FIFA Quality Pro level specifications are required to embody a circumference of from 685 millimeters to about 695 millimeters, a weight of from 420 grams to 445 grams, a sphericity max percentage of 1.5%, and a rebound height of from 135 centimeters to 155 centimeters at 2.0 degrees Celsius. Further, a restriction structure 22 formed via the particular overlapping strips 15 of FIGS. 5-6 of the present disclosure, allows for efficient manufacturing of the restriction structure 22 while mitigating waste of the material, which comprises the respective overlapping strips 15 thereof.

As shown in FIGS. 1-4, the sports ball 10 may be an inflatable sports ball 10 such as a soccer ball or the like. A sports ball 10 having the general configuration of a soccer ball is depicted in FIGS. 1-4. As shown in FIGS. 3, 4, and 8-11G, the sports ball 10 may have a layered structure including an interior 16, an intermediate structure 14, and an outer cover layer 24. The outer cover layer 24 forms an exterior portion of the sports ball 10. The interior 16 forms an interior portion of the sports ball 10.

Figure 2:
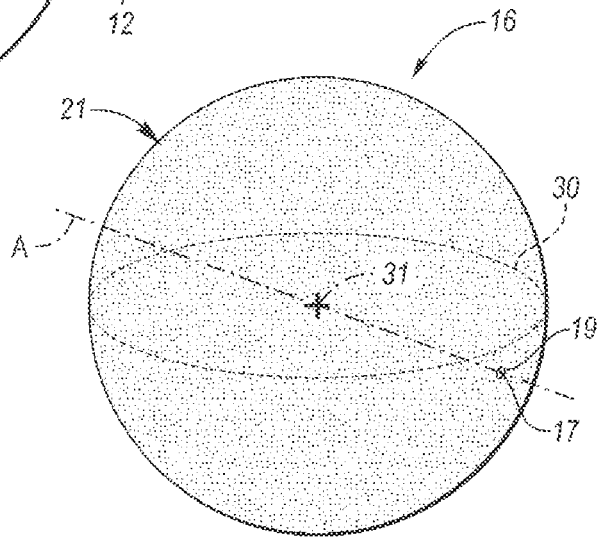
FIG. 2 is a schematic perspective view of an example bladder defining an exterior bladder surface, a bladder circumference, and a valve opening.

The interior may be a bladder 16 (FIGS. 2, 3, 8 and 10) having an exterior bladder surface 21. The bladder 16 may be formed from a variety of elastomeric or otherwise stretchable materials and may be further capable of being inflated to a predetermined internal pressure. More particularly, the bladder 16 may be formed of a Thermoplastic Polyurethane (TPU) material or a rubber material. In order to facilitate inflation (i.e., fill the interior with pressurized air) of the bladder 16 to the predetermined internal pressure, the bladder 16 defines a valved opening 19 that houses a valve 17 and extends through the bladder 16, the outer cover layer 24, and the intermediate structure 14, thereby allowing access to the valve 17 from an exterior surface 13 of the sports ball 10. Upon inflation, the bladder 16 is pressurized and the pressurization induces the exterior bladder surface 21 and the exterior surface 13 of the sports ball 10 to be non-planar and substantially-spherical surfaces, as the sports ball 10 takes on a substantially-spherical shape. As shown in FIGS. 2 and 4, the ball 10 may have an interior center 31 and a central axis A that runs through the interior center 31. The valve 17 and the valved opening 19 may be positioned on the central axis A.

In some examples, a counterweight 32 (FIG. 4) may be disposed on the central axis A opposite the valve 17 on the ball 10 to better balance the resultant sports ball 10. In this way, the counterweight 32 is positioned diametrically opposite the inflation valve 17 to counterbalance the weight of the inflation valve 17 and position the center of gravity of the ball 10, when inflated to the predetermined internal pressure, at the geometric center 31 of the sphere. The counterweight 32 may be a textile patch, a foam patch, or the like.

The casing 12 is disposed about the interior bladder 16 and forms an exterior portion of the sports ball 10, which further defines the exterior surface 13. As shown in FIGS. 3 and 8-11G, the casing 12 may comprise a layered structure including an outer cover layer 24 and an intermediate structure 14 located interior to the outer cover layer 24 between the outer cover layer 24 and the bladder 16. Said another way, the intermediate structure 14 is disposed between the outer cover layer 24 and the bladder 16.

The intermediate structure 14 forms a middle portion of the sports ball 10 and is positioned between the outer cover layer 24 and the bladder 16. Among other purposes, the intermediate structure 14 may provide a softened feel to the sport ball 10, impart energy return, and restrict expansion of the bladder 16. In some configurations, the intermediate structure 14 or portions of the intermediate structure 14 may be bonded, joined, or otherwise incorporated into the outer cover layer 24 as a backing material. In other configurations, the intermediate structure 14 or portions of the intermediate structure 14 may be bonded, joined, or otherwise incorporated into the interior 16.

The intermediate structure 14 may include a restriction structure 22 and a plurality of intermediate layers 26*a*, 26*b*. The restriction structure 22 is disposed in contact with the bladder exterior surface 21. The plurality of intermediate layers 26*a*, 26*b* are disposed between the outer cover layer 24 and the restriction structure 22, and may be bonded, joined, or otherwise incorporated into the outer cover layer 24 as a backing material. The counterweight 32 may be disposed upon the restriction structure 22 between the restriction structure 22 and the intermediate layers 26*a*, 26*b*.

The intermediate layers 26*a*, 26*b* may include a first intermediate layer 26*a* and a second intermediate layer 26*b*. The first intermediate layer 26*a* is disposed between the second intermediate layer 26*b* and the outer cover layer 24. The second intermediate layer 26*b* is disposed between the first intermediate layer 26*a* and the restriction structure 22. The intermediate layers 26*a*, 26*b* may be comprised of a suitable textile material or foam material. Examples of suitable polymer foam materials include, but are not limited to, polyurethane, ethylvinylacetate, and the like. Examples of suitable textile materials include, but are not limited to, a woven or knit textile formed from polyester, cotton, nylon, rayon, silk, spandex, or a variety of other materials. A textile material may also include multiple materials, such as a polyester and cotton blend.

The intermediate layers 26*a*, 26*b* provide a softened feel to the sports ball 10 and provide insulation of the bladder 16 to minimize sound generated by striking the air-filled and pressurized bladder 16. In one example configuration, the first intermediate layer 26*a* may comprise a thermoplastic foam material, and more particularly, a Thermoplastic Polyurethane (TPU) foam material. In such an example, the second intermediate cover layer 26*b* may comprise a winding layer, wherein a textile yard, thread, or filament is repeatedly wound about the restriction structure 22 to form a mesh that covers substantially all of the restriction structure 22. In this way, the second intermediate layer 26*b* allows for optimization of the size and weight dimensions of the ball 10, while imparting improved rebound characteristics. In other embodiments, each of the intermediate layers 26*a*, 26*b* may comprise foam materials.

The restriction structure 22 may have a variety of configurations and/or functional purposes, including, but not limited to, restricting expansion of the bladder 16, imparting energy return, and improving consistency in the size, weight, balance, and rebound properties of the sports ball 10. Upon pressurization to a predetermined internal pressure, the bladder 16 induces the sports ball 10 to take on a non-planar and substantially spherical shape. More particularly, pressure within the bladder 16 causes the exterior bladder surface 21 to place an outward force upon the restriction structure 22, which is disposed in contact with the bladder exterior surface 21. In turn, the restriction structure 22 places an outward force upon the casing 12, particularly the second intermediate layer 26*b*. Said another way, bladder 16 places an outward force upon restriction structure 22, but the reduced stretch characteristics of restriction structure 22 effectively mitigate the outward force from inducing significant tension in casing 12. As such, the restriction structure 22 restrains pressure from the bladder 16, while permitting outward forces to induce a non-planar and substantially-spherical shape in the casing 12, thereby imparting a substantially-spherical shape to the sports ball 10.

As such, in general, the restriction structure 22 may be formed from materials with a limited degree of stretch in order to limit the expansion of bladder 16 and also limit tension in casing 12, or, alternatively, restriction structures 22 formed from a mildly-stretchable material may be paired with a material with a limited degree of stretch in order to limit the expansion of the bladder 16, while also improving rebound and resilience characteristics of the sports ball 10. Accordingly, the construction of the restriction structure 22 may vary significantly to include a variety of configurations and materials.

As examples, conventional restriction structures may be formed from (a) thread, yarn, or filament that is repeatedly wound around bladder 16 in various directions to form a mesh that covers substantially all of a bladder 16, (b) a plurality of generally flat or planar strips that are impregnated with latex and placed in an overlapping configuration around bladder 16, or (c) a substantially seamless textile. In utilizing a conventional restriction structure such as (a)-(c) detailed herein above, there is generally a large amount of textile material as well as latex or resin binder needed to provide the necessary restriction of the bladder 16, which causes difficulties in controlling the dimensions, i.e., the size, weight, and sphericity of the resultant sports ball 10, as well as less predictability in consistency of the flight characteristics, rebound and resilience characteristics, and touch properties of the ball 10.

More particularly, the amount of material utilized for a conventional restriction structure 22 to achieve the desired sound characteristics, improved resilience, and improved rebound properties often produces a ball 10 that is heavier or larger in diameter and/or circumference than desired or required by specifications such as the specifications set forth by Federation Internationale de Football Association (FIFA) for Size 5 FIFA Quality Pro level soccer balls. Application of conventional restriction structures to the bladder 16 in the manufacturing process also produces inconsistencies in the dimensions, i.e., the size, weight, and sphericity of the resultant sports ball 10. These inconsistencies can be solved via the present disclosure.

As shown in FIGS. 4-6, 8, and 10 the restriction structure 22 of the present disclosure is composed of a plurality of overlapping strips 15, such that the restriction structure 22 comprises a uniform number of radially-stacked layers of the overlapping strips 15 or a uniform thickness over a substantial entirety of the exterior bladder surface 21. Further, the restriction structure 22 is formed in a non-planar configuration and is shaped to conform with exterior bladder surface 21 (FIG. 4), when the bladder 16 is inflated.

In one example, the overlapping strips 15 may comprise a textile material. The textile material may be a woven, knit, or similarly formed textile. The textile material may further incorporate an elastomeric element, to refine the stretch characteristics of the textile material. The textile material may further incorporate a thermoplastic component or be impregnated with a thermoplastic component, such that the overlapping strips 15 or layers thereof may be welded together. Accordingly, examples of suitable textile materials include, but are not limited to, a muslin material, a canvas material, a woven or knit textile formed from wool, polyester, cotton, nylon, rayon, silk, spandex, or a variety of other materials. A textile material may also include multiple materials, such as a polyester and cotton blend. Examples of suitable thermoplastic components may include, but are not limited to, polyurethane, polyethylene, polypropylene, polyvinyl chloride, polystyrene, acrylic, nylon, and the like.

In another example, the overlapping strips 15 may comprise an elastomeric material. The elastomeric material may be a rubber material, a Thermoplastic Polyurethane (TPU) material, or another suitable elastomeric material. In such an example, wherein the overlapping strips 15 comprise an elastomeric material, the overall resilience and rebound properties of the resultant sports ball 10 may be improved. However, in such an example, the elastomeric material alone may not have the requisite limited stretch properties to sufficiently restrain expansion of the bladder 16. As such, in an example wherein the overlapping strips 15 comprise an elastomeric material, the second intermediate layer 26*b* of the intermediate structure 14 may be comprised of a winding layer. In such an example, the winding layer comprises at least one of a textile yard, thread, or filament that is repeatedly wound about the overlapping strips 15 of the restriction structure 22 to form a mesh that covers substantially all of the restriction structure 22. In this way, the winding layer provides that the additional limited stretch properties to the intermediate structure 14 to sufficiently restrain expansion of the bladder 16, while the elastomeric material of the restriction structure 22 allows for the improved rebound and resilience properties of the resultant sports ball 10. The winding layer also provides for the ability to improve or optimize the size, weight, and sphericity of the resultant sports ball 10 during the manufacturing process.

Figure 6:
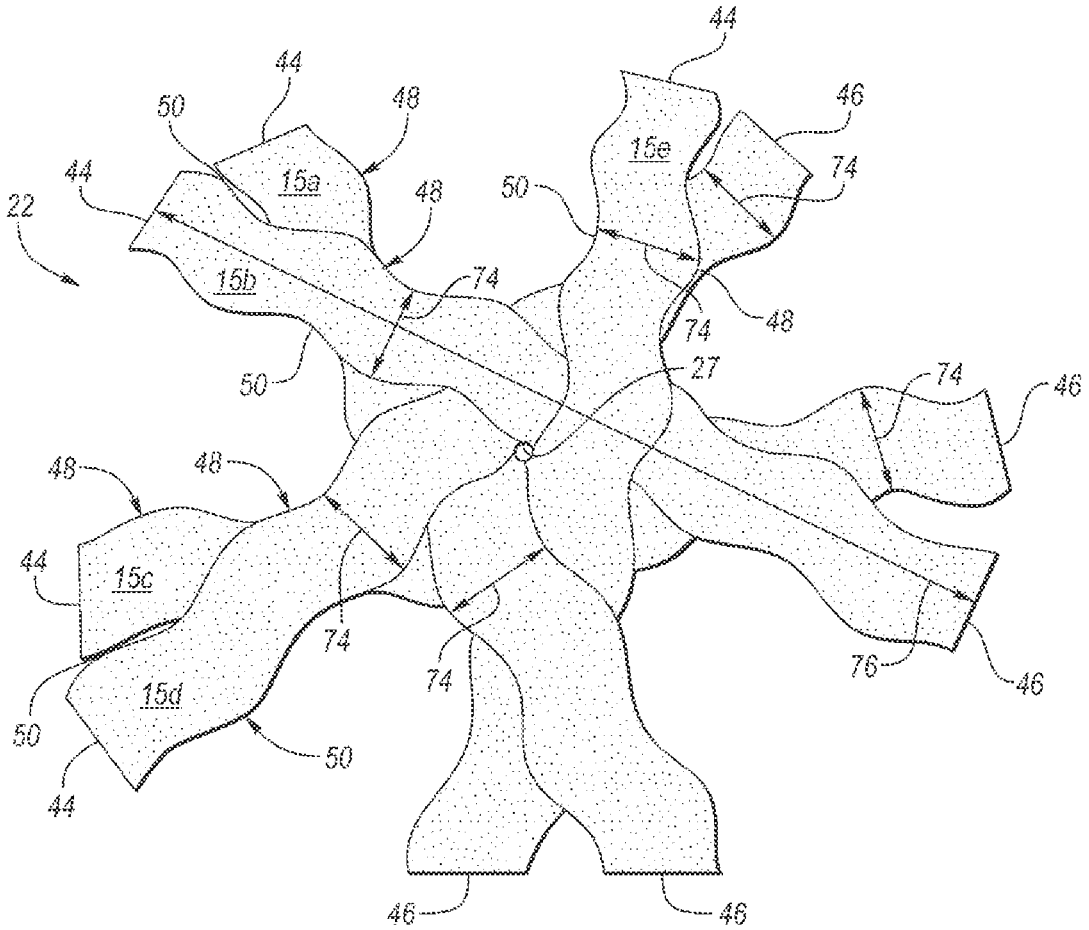
FIG. 6 is a schematic plan view of a plurality of overlapping and interwoven strips prior to wrapping the same about the bladder circumference, wherein the overlapping and interwoven strips define a valve opening central thereto.
Figure 8:
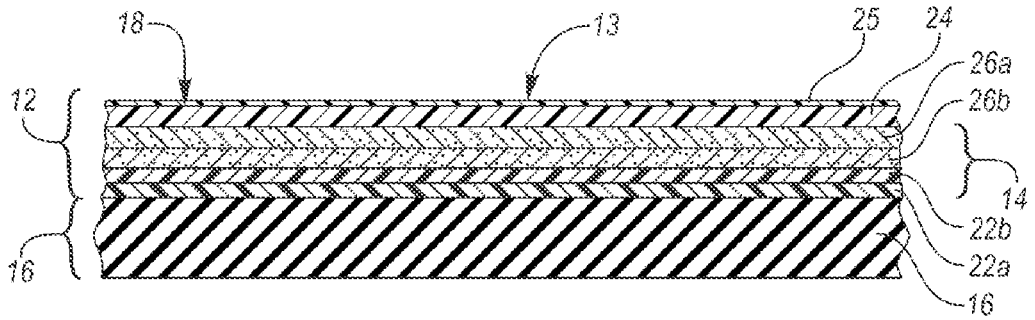
FIG. 8 is an example cross-section view of the casing, as shown in FIG. 3, taken along line 8-8.
Figure 10:
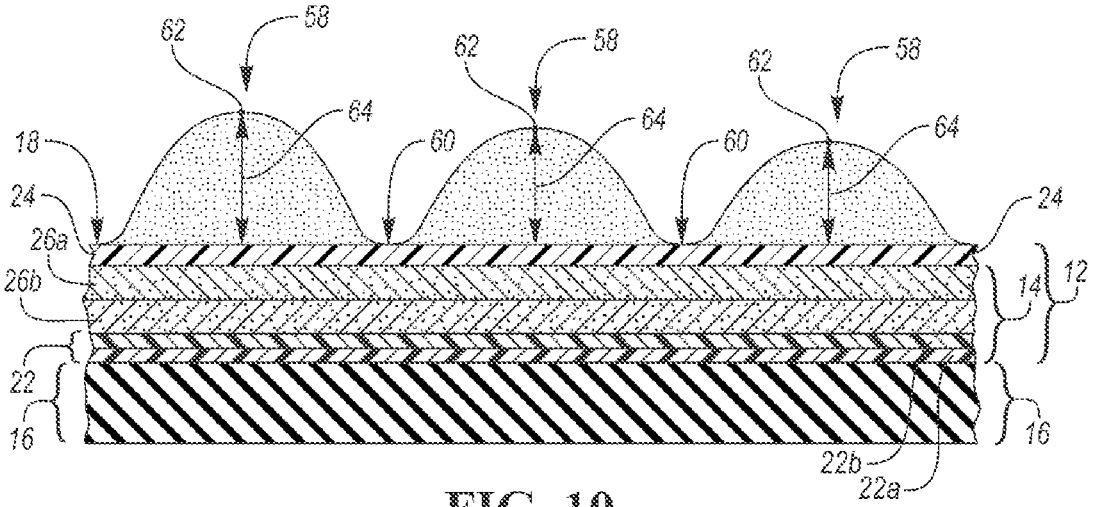
FIG. 10 is an enlarged, schematic cross-sectional view of an example ball having a plurality of protrusions extending from the outer cover layer surface.

As illustrated in FIGS. 4 and 6, the plurality of overlapping strips 15 may be arranged prior to assembly on the bladder 16, to define a nexus void 27. In this way, the nexus void 27 is disposed on the central axis A, such that the nexus void 27 is aligned with the valve 17 and the valved opening 19 and the valve 17 is disposed in the nexus void 27. As shown in FIGS. 8 and 10, once the plurality of strips 15 is disposed on and wrapped about the bladder 16, a uniform number of radially-stacked layers of overlapping strips 15 within the restriction structure 22 are disposed over a substantial entirety of the exterior bladder surface 21. For example, the restriction structure 22 may comprise a first layer 22*a* of overlapping strips 15 and a second layer 22*b* of overlapping strips 15 over the entirety of the exterior bladder surface 21.

Each strip 15 has a first end 44, a second end 46, a first edge 48, and a second edge 50. The first end 44 is positioned opposite the second end 46, such that a length 76 of the respective strip 15 is measured from the first end 44 to the second end 46. The first edge 48 is further positioned opposite the second edge 50, such that a width 74 of the respective strip 15 is measured from the first edge 48 to the second edge 50. Further each of the first edge 48 and the second edge 50 extend from the first end 44 to the second end 46 of each respective strip 15. Each strip 15 may further define an aspect ratio of length 76 to width 74. The aspect ratio of length 76 to width 74 may be from about 1:1 to about 15:1.

In one example embodiment, the aspect ratio of length 76 to width 74 of the respective strip 15 may be from about 1:1 to about 5:1. In such an example embodiment, which is partially illustrated in FIGS. 8 and 10, the plurality of strips 15 may comprise a plurality of overlapping patches disposed about the entirety of the exterior bladder surface 21. In such an example, the first layer 22*a* is welded to the second layer 22*b* across the entirety of the exterior bladder surface 21 and throughout the restriction structure 22. As utilized and further defined herein, the term "welding" or variants thereof (such as "thermal bonding") is defined as a technique for securing two elements to one another that involves a softening or melting of a polymer material within at least one of the elements such that the materials of the elements are secured to each other when cooled. Similarly, the term "weld" or variants thereof (e.g., "thermal bond") is defined as the bond, link, or structure that joins two elements through a process that involves a softening or melting of a polymer material within at least one of the elements such that the materials of the elements are secured to each other when cooled.

In another example embodiment, as illustrated in FIGS. 4-6, 8, and 10, the aspect ratio of length 76 to width 74 of the respective strip 15 may be greater than about 8:1 and more particularly about 10:1. Said another way, the width 74 of the respective strip 15 may be quantified as from about $1/8^{th}$ to about $1/10^{th}$ of the length 76 or from about 10% to about 13% of the length 76 of the respective strip 15. Such length 76 and width 74 dimensions for the strips 15, namely, an aspect ratio of length 76 to width 74 of from about 8:1 to about 10:1, provide for a mitigation of waste material in the manufacture of the restriction structure 22.

In such an example, the length 76 of the respective strip 15 may be substantially the same as the measurement of the bladder circumference 30, when the sports ball 10 is inflated to the predetermined internal pressure. As such, the width 74 of the respective strip 15 may be quantified as from about $1/8^{th}$ to about $1/10^{th}$ of the measurement of the bladder circumference 30, when the sports ball 10 is inflated to the predetermined internal pressure and/or from about 10% to about 13% of the bladder circumference 30, when the sports ball 10 is fully inflated to the predetermined internal pressure.

Figure 4:
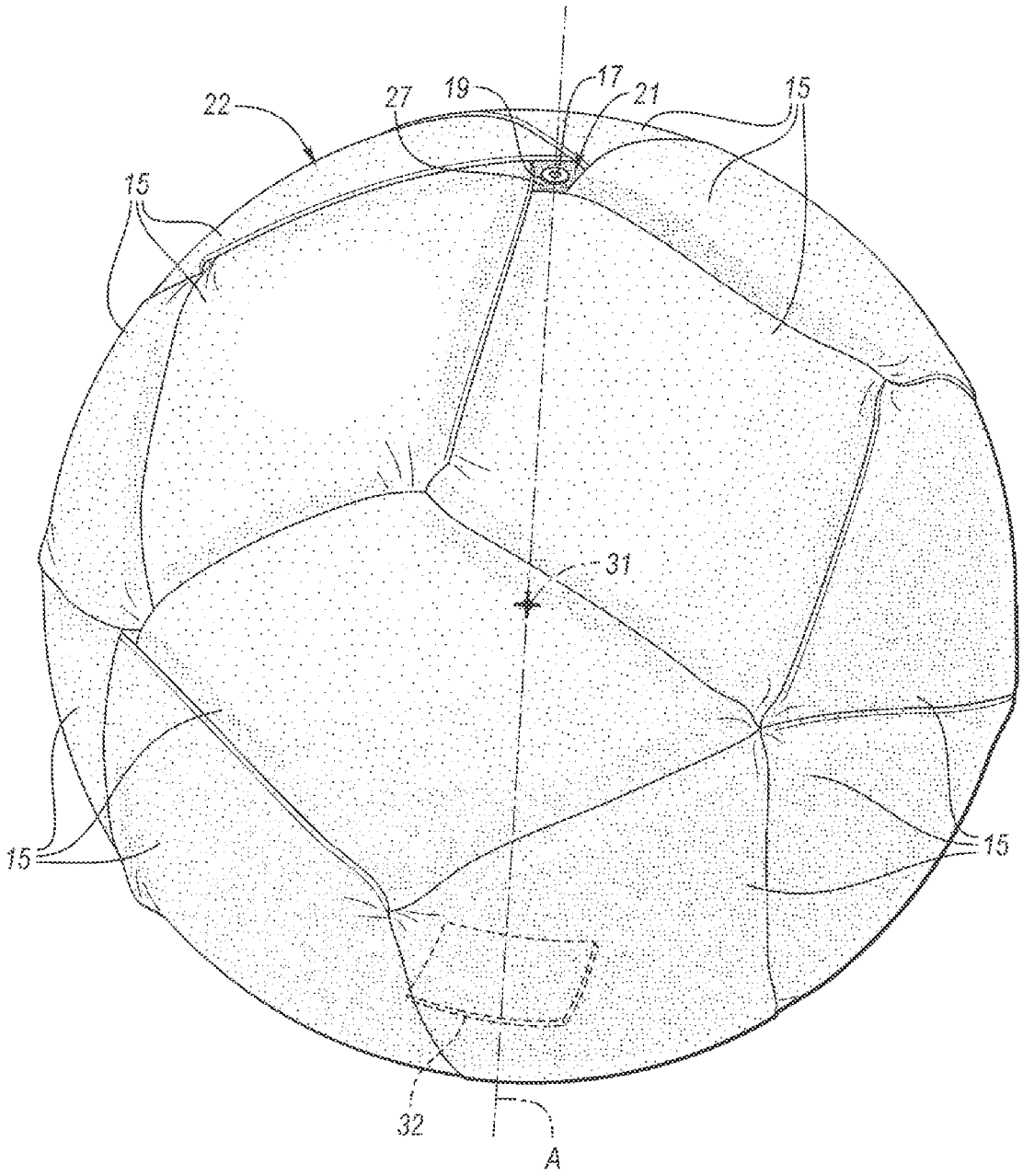
FIG. 4 is a schematic perspective view of an example bladder wrapped with a plurality of overlapping strips, which form a restriction structure.
Figure 5:
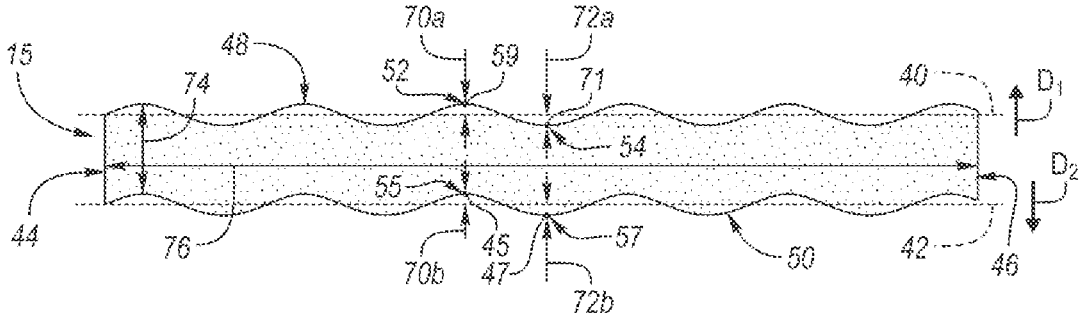
FIG. 5 is a schematic plan view of an example strip.

In such an example, and as illustrated in FIGS. 4-6, the plurality of overlapping strips 15 may be further defined as a plurality of overlapping and interwoven strips 15 (FIG. 5). In such an example, the restriction structure 22 again comprises a uniform number of radially-stacked layers of the overlapping and interwoven strips 15 over a substantial entirety of the exterior bladder surface 21, for example, two layers, namely, a first layer 22*a* and a second layer 22*b*. In such an example, the first layer 22*a* is interwoven with and welded to the second layer 22*b*.

In one example, wherein the plurality of overlapping strips 15 are further defined as a plurality of overlapping and interwoven strips 15, each strip 15 may be formed in a linear configuration, such that each of the first edge 48 and the second edge 50 are linear. While being linear in configuration, the first edge 48 and the second edge 50 remain substantially parallel along the length 76 of the respective strip 15.

In another example, wherein the plurality of overlapping strips 15 are further defined as a plurality of overlapping and interwoven strips 15, each strip 15 may be formed in a wave-like configuration as illustrated by example in FIG. 5. Referring to FIG. 5, the first edge 48 and second edge 50 define a wave-like configuration comprising a plurality of crests and a plurality of depressions. In such an example, the first edge 48 is non-linear and the second edge 50 is non-linear.

The first edge 48 may define a first plurality of crests 52, a first plurality of depressions 54, and a first edge equilibrium 40. Each crest 52 of the first plurality of crests extends to a crest terminus 59 that is spaced apart from the first edge equilibrium 40 in a first direction D1 by a first edge crest height 70*a*. Each depression 54 of the first plurality of depressions extends to a depression terminus 71 that is spaced apart from the first edge equilibrium 40 in a second direction D2, which is opposite the first direction D1, by a first edge depression depth 72*a*.

The second edge 50 may define a second plurality of crests 55, a second plurality of depressions 57, and a second edge equilibrium 42. Each crest 55 of the second plurality of crests extends to a crest terminus 45 that is spaced apart from the second edge equilibrium 42 in the first direction D1 by a second edge crest height 70*b*. Each depression 57 of the second plurality of depressions extends to a depression terminus 47 that is spaced apart from the second edge equilibrium 42 in the second direction D2 by a second edge depression depth 72*b*.

Further, the first plurality of crests 52 and the first plurality of depressions 54 may further comprise an alternating and repeating series of crests 52 and depressions 54, such that the first edge 48 takes on a wave-like configuration. In this way, each crest 52 is positioned between two depressions 54 and each depression 54 is positioned between two crests 52. Likewise, the second plurality of crests 55 and the second plurality of depressions 57 may further comprise an alternating and repeating series of crests 55 and depressions 57, such that the second edge 50 takes on a wave-like configuration. In this way, each crest 55 is positioned between two depressions 57 and each depression 57 is positioned between two crests 55.

However, while being non-linear in configuration, the first edge 48 and the second edge 50 remain substantially parallel along the length 76 of the respective strip 15. Accordingly, each crest 52 of the first plurality of crests is aligned with one of the crests 55 of the second plurality of crests and each depression 54 of the first plurality of depressions is aligned with one of the depressions 57 from the second plurality of depressions.

More particularly, the first edge crest height 70*a* is substantially the same as the first edge depression depth 72*a*. The second edge crest height 70*b* is substantially the same as the second edge depression depth 72*b*. The first edge crest height 70*a* is substantially the same as the second edge crest height 70*b*. The first edge depression depth 72*a* is substantially the same as the second edge depression depth 72*b*. Further, the first edge crest height 70*a* and the first edge depression depth 72*a* cooperate to define the wave amplitude of the first edge 48. Likewise, the second edge crest height 70*b* and the second edge depression depth 72*b* cooperate to define the wave amplitude of the second edge 50.

In one example, as illustrated in FIG. 5, the wave amplitude of the first edge 48 is from about $1/8^{th}$ or 12.5% of the width 74 of the respective strip 15 to about $1/3^{rd}$ or 33% of the width 74 of the respective strip 15. Likewise, the wave amplitude of the second edge 50 is from about $1/8^{th}$ or 12.5% of the width 74 of the respective strip 15 to about $1/3^{rd}$ or 33% of the width 74 of the respective strip 15. More particularly, in one example, the wave amplitude of each of the first edge 48 and the second edge 50 is about $1/4^{th}$ or about 25% of the width 74 of the respective strip 15.

Said another way, the first crest height 70*a*, the second crest height 70*b*, the first depression depth 72*a*, and the second depression depth 72*b* may quantified as from about $1/16^{th}$ or 6.25% of the width 74 of the respective strip 15 to about $1/6^{th}$ or 17% of the width 74 of the respective strip 15. More particularly, the first crest height 70*a*, the second crest height 70*b*, the first depression depth 72*a*, and the second depression depth 72*b* may be quantified as approximately $1/8^{th}$ of or from about 12% to about 13% of the width 74 of the respective strip 15, such that the ratio of first crest height 70*a* to width 74 is about 1:8, the ratio of second crest height 70*b* to width 74 is about 1:8, the ratio of first depression depth 72*a* to width 74 is about 1:8, the ratio of second depression depth 72*b* to width 74 is about 1:8.

In one example embodiment, the plurality of overlapping and interwoven strips 15 comprises six overlapping and interwoven strips 15, namely, a first strip 15*a*, a second strip 15*b*, a third strip 15*c*, a fourth strip 15*d*, a fifth strip 15*e*, and a sixth strip 15*f* (FIG. 6). In the six-strip example, illustrated in FIGS. 4 and 6, the first strip 15*a*, the second strip 15*b*, the third strip 15*c*, the fourth strip 15*d*, and the fifth strip 15*e* are positioned radially about the nexus void 27, such that the nexus void 27 is disposed between the first end 44 and the second end 46 of each of the respective strips 15 (FIG. 6). Each of the first strip 15*a*, the second strip 15*b*, the third strip 15*c*, the fourth strip 15*d*, and the fifth strip 15*e* are interwoven with each of the other strips 15 (FIG. 6) and wrapped about the bladder circumference 30 (FIG. 4).

Once wrapped about the bladder circumference 30, the first end 44 of the respective strip 15 is positioned adjacent to and in contact with the second end 46 of that respective strip 15, such that the first end 44 abuts the second end 46 thereby forming a restrictor ring about the bladder circumference 30. More particularly, the first end 44 of the first strip 15*a* is positioned adjacent to and in contact with the second end 46 of the first strip 15*a*, the first end 44 of the second strip 15*b* is positioned adjacent to and in contact with the second end 46 of the second strip 15*b*, the first end 44 of the third strip 15*c* is positioned adjacent to and in contact with the second end 46 of the third strip 15*c*, the first end 44 of the fourth strip 15*d* is positioned adjacent to and in contact with the second end 46 of the fourth strip 15*d*, and the first end 44 of the fifth strip 15*e* is positioned adjacent to and in contact with the second end 46 of the fifth strip 15*e*, when the plurality of strips 15 of FIG. 5 are overlapped and interwoven about the bladder circumference 30. The sixth strip 15*f* is then disposed about the equator of the bladder 16 and wrapped about the bladder circumference 30, such that the first end 44 of the sixth strip 15*f* is positioned adjacent to and in contact with the second end 46 of the sixth strip 15*f*.

The first end 44 and second end 46 of the respective strips 15 may be fixed to one another via welding, adhesive binder, stitching, or another suitable coupling mechanism, such that the respective restrictor ring is interwoven with each of the other restrictor rings and secured about the bladder circumference 30.

In some embodiments, the outer cover layer 24 may be composed of a variety of suitable materials including leather and/or suitable polymeric materials. In some configurations the outer cover layer 24 is composed of a polymeric material, a polymer foam material, or the like. Examples of suitable polymeric materials include, but are not limited to, polyurethane, polyvinylchloride, polyamide, polyester, polypropylene, polyolefin, and/or other materials that are generally durable and wear-resistant. In one example, the outer cover layer 24 may be formed of a thermoplastic polyurethane material (TPU).

As shown in FIGS. 1, 3, and 7A-7E, the outer cover layer 24 may be generally formed by a plurality of adjoining panels 28, wherein each panel 28 has a respective panel surface that defines a portion of the outer cover layer surface 18. The plurality of panels 28 may comprise the conventional twelve (12) panels or any other number of panels 28, for example, four joined panels 28 each having nine edges 36 and having a generally triangular shape that is formed from three pentagons. Panels 28 may also have a variety of other shapes (e.g., triangular, square, rectangular, trapezoidal, round, oval) that combine in a tessellation-type manner to form the outer cover layer 24. Further, panels 28 may also exhibit non-regular or non-geometrical shapes. The outer cover layer 24 may also exhibit a substantially uniform or unbroken configuration that does not include panels 28 joined at abutting edge areas 36 via seams 38 or may include fewer panels 28.

As shown in FIGS. 1, 3, 7A-7E, 9, 10, and 11A-11G, the outer cover layer 24 may further define a plurality of surface features 34, 38, 58. The plurality of surface features 34, 38, 58 may include a first plurality of indentations 38, a second plurality of indentations 34, and a plurality of protrusions 58. The outer cover layer surface 18 may define a plurality of land areas 60 disposed between the respective indentations 34, 38 and/or protrusions 58. Further, the protrusions 58, the land areas 60, the first plurality of indentations 38, and second plurality of indentations 34 may cooperate to define a topographical arrangement across the exterior surface 13 of the sports ball 10.

Figure 9:
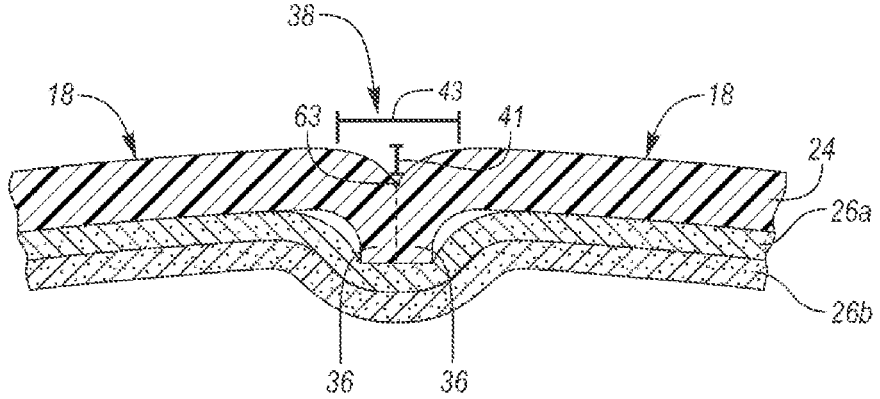
FIG. 9 is an enlarged, schematic, example cross-section of an example indentation shown in FIG. 1, taken along line 9-9, wherein the indentation is defined as a seam.

As shown in FIG. 9, the first plurality of indentations 38 may have a first indentation terminus 63 radially-spaced apart from the outer cover layer surface 18 in a direction toward the interior bladder 16. Further, each of the first plurality of indentations 38 has a first indentation depth 41 and a first indentation width 43. The first indentation terminus 63 is radially-spaced apart from the outer cover layer surface 18 by the first indentation depth 41. In one example, as shown in FIG. 9, the first plurality of indentations 38 may be defined as a plurality of seams 38 configured to couple the plurality of panels 28. In one example, the first plurality of indentations 38 are defined as seams, the first indentation width 43 is a seam width and the first indentation depth 41 is a seam depth.

Figure 3:
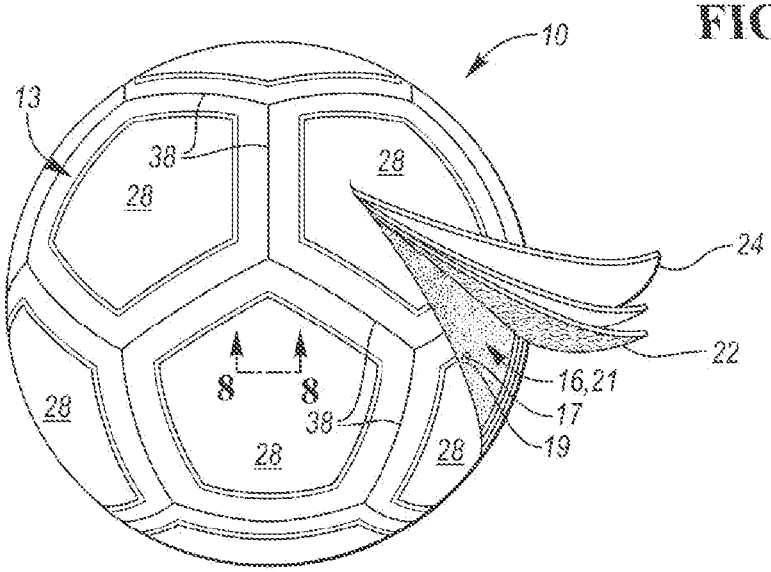
FIG. 3 is a schematic perspective view of an example inflatable sports ball, wherein the ball includes an interior bladder and a casing, the casing including an outer cover layer and an intermediate structure.

The respective panels 28 may be joined together along abutting edge areas 36 (FIG. 7A-7E) via at least one seam 38 (FIGS. 1 and 3). The panels 28 may be coupled along the abutting edge areas 36 by the seam 38 with stitching, bonding, welding, adhesives, or another suitable coupling method.

An example of welded seams 38 is disclosed in U.S. Pat. No. 8,608,599 to Raynak, et al., which is hereby entirely incorporated herein by reference. U.S. Pat. No. 8,608,599 to Raynak, et al. generally discloses examples of welded seams, in that welding generally produces a heat affected zone in which the materials of the two joined components are intermingled. This heat affected zone may be considered a "weld" or "thermal bond." Further, welding may involve (a) the melting or softening of two panels that include polymer materials such that the polymer materials from each panel intermingle with each other (e.g., diffuse across a boundary layer between the polymer materials) and are secured together when cooled, as well as (b) the melting or softening of a polymer material in a first panel such that the polymer material extends into or infiltrates the structure of a second panel (e.g., infiltrates crevices or cavities formed in the second panel or extends around or bonds with filaments or fibers in the second panel) to secure the panels together when cooled. Further, welding may occur when only one panel includes a polymer material or when both panels include polymer materials.

Referring to FIGS. 7A-7E and 11A-11G, each of the second plurality of indentations 34 may have a second indentation terminus 65 radially-spaced apart from the outer cover layer surface 18 in a direction toward the interior bladder 16. Further, each of the second plurality of indentations 34 has a second indentation depth 67 and a second indentation width 61. The second indentation terminus 65 is radially-spaced apart from the outer cover layer surface 18 by the second indentation depth 67.

Figure 7A:
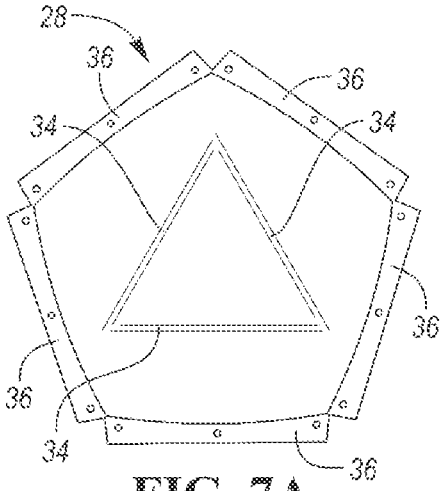
FIG. 7A is an example schematic plan view of an example panel having surface features formed thereon.
Figure 7B:
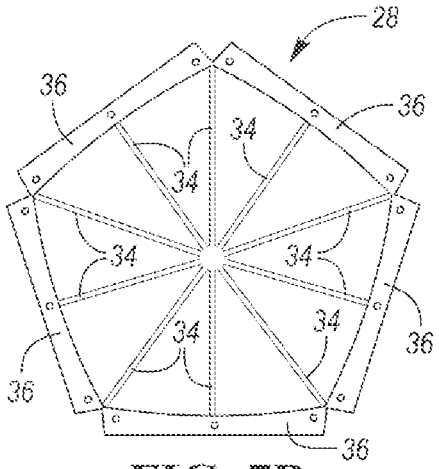
FIG. 7B is an example schematic plan view of an example panel having surface features formed thereon.
Figure 7C:
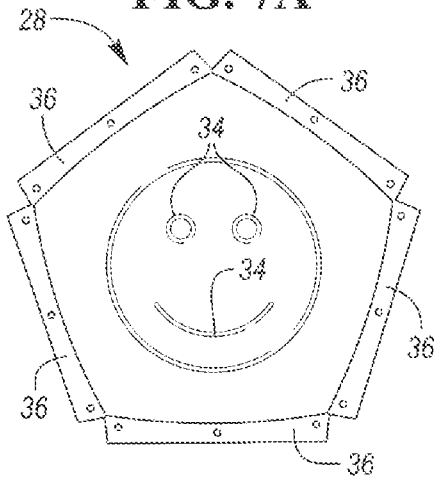
FIG. 7C is an example schematic plan view of an example panel having surface features formed thereon.
Figure 7D:
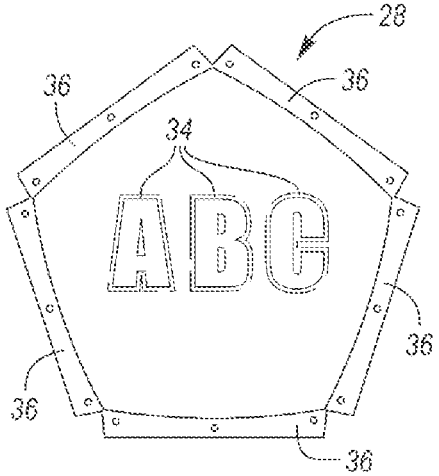
FIG. 7D is an example schematic plan view of an example panel having surface features formed thereon.

The second plurality of indentations 34 may be defined as a plurality of channels. In some example embodiments, the channels 34 may be spaced apart from the seams 38 of the sports ball 10 (FIGS. 7A, 7C, 7D, 7E). In other example embodiments, the channels 34 may extend to edges 36 of the panels 28 and, thus, continue across a respective seam 38 (FIG. 7B). More particularly, a channel 34 on a first panel and a channel 34 on a second panel may be in substantial alignment with one another across a respective seam 38. This may also enable patterns, arrangements, or other designs to be carried across multiple panels, bridging seams 38 between the panels 28. Channels 34 may impart various advantages to ball 10. For example, channels 34 may enhance the aerodynamics of ball 10, provide a greater amount of consistency or control over ball 10 during play, e.g., during kicking, dribbling, or passing, improve ball feel, and provide for water channeling.

Channels 34 may be formed in the outer cover layer 24 via a variety of manufacturing processes including, but not limited to, debossing. Examples of a manufacturing process for forming channels 34 are disclosed in U.S. Pat. No. 9,370,693 to Berggren, et al., which is hereby entirely incorporated by reference herein. U.S. Pat. No. 9,370,693 to Berggren, et al. generally discloses a variety of manufacturing processes that may be utilized to form debossed features in panels. In one example, one of the panels is located on a platen. A press plate is positioned above the platen and includes an extension portion having a predetermined shape. The extension portion presses into and heats the areas of panel forming the debossed features. The press plate then moves away from the panel to substantially complete the formation of the debossed feature.

As shown in FIGS. 11A-11G, each channel 34 has a channel terminus 65 that is radially-spaced apart from the outer cover layer surface 18 in a direction toward the interior bladder 16. Further, each channel 34 has a channel depth 67 and a channel width 61. The channel terminus 65 is radially-spaced apart from the outer cover layer surface 18 the channel depth 67.

The channels 34 are formed in the outer cover layer 24 and extend toward the interior bladder 16. The intermediate layers 26*a*, 26*b* of the intermediate structure 14 are positioned between outer cover layer 24 and the restriction structure 22. The outer cover layer 24 may be bonded to one of the intermediate layers 26*a*, 26*b* at the respective channel 34. More particularly, the outer cover layer 24 may be welded directly to the second intermediate layer 26*b* at the channel terminus 65 of the respective channel 34 (FIGS.

11A-C and 11E-G), such that the outer cover layer 24 extends through an entirety of the channel depth 67 at each of the channels 34.

The channel 34 may include an exterior indentation 82 and an interior indentation 84. The exterior indentation 82 has the terminus 65 that is radially-spaced apart from the outer cover layer surface 18 by the channel depth 67.

Figure 11A:
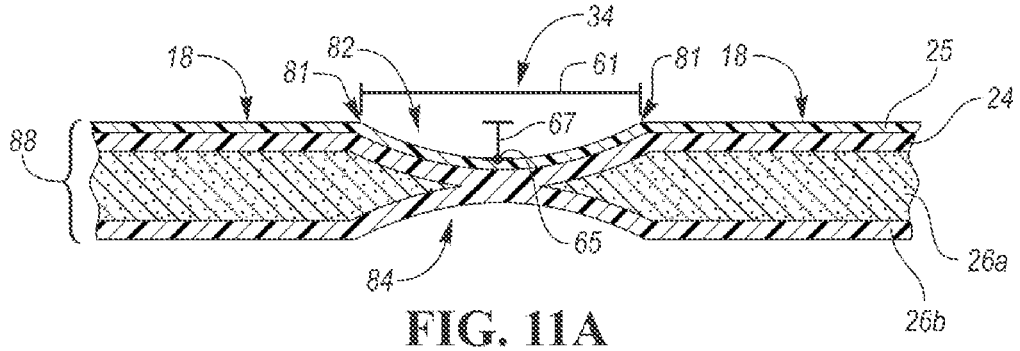
FIG. 11A is an enlarged, schematic, example cross sectional view of an example indentation, wherein the indentation is defined as a channel.
Figure 11B:
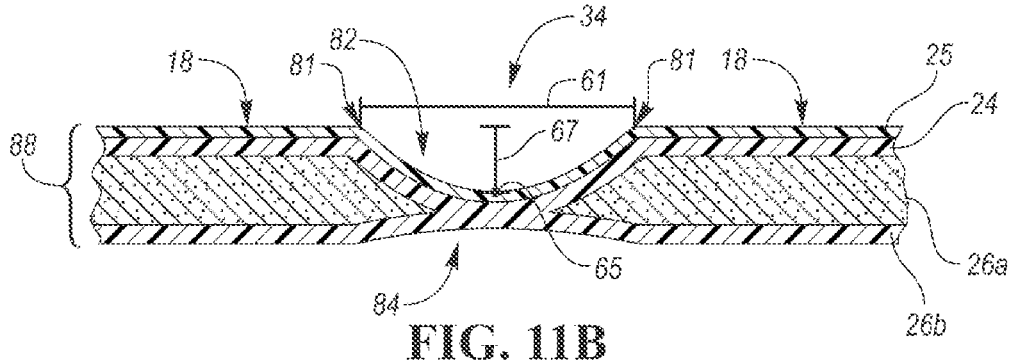
FIG. 11B is an enlarged, schematic, example cross sectional view of an example indentation, wherein the indentation is defined as a channel.
Figure 11C:
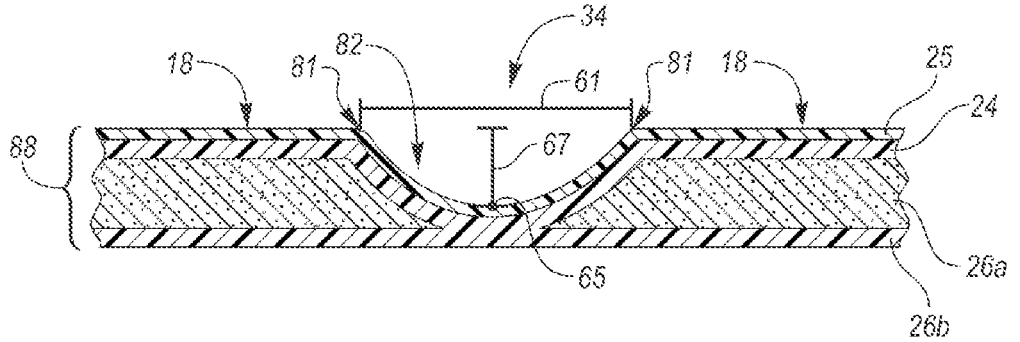
FIG. 11C is an enlarged, schematic, example cross sectional view of an example indentation, wherein the indentation is defined as a channel.

The specific configuration of the channel 34 may vary considerably. Referring to FIGS. 11A-11D, the exterior and interior indentations 82 and 84 may have a generally rounded configuration. As depicted in FIG. 11A the interior and exterior indentations 82 and 84 extend to an approximate midpoint of a thickness 88 of the panel cross-section. In another configuration, as depicted in FIG. 11B, the exterior indentation 82 extends through more of the thickness 88 of panel cross section than the interior indentation 84. In yet another configuration, as depicted in FIG. 11C, the exterior indentation 82 extends through substantially all of the thickness 88 of panel cross-section. As also shown in FIG. 11C, in some embodiments, the second intermediate layer 26*b* may have a substantially planar configuration opposite the exterior indentation 82. Said another way, in some embodiments, the channel 34 may have only an exterior indentation 82 and no interior indentation 84.

Figure 11D:
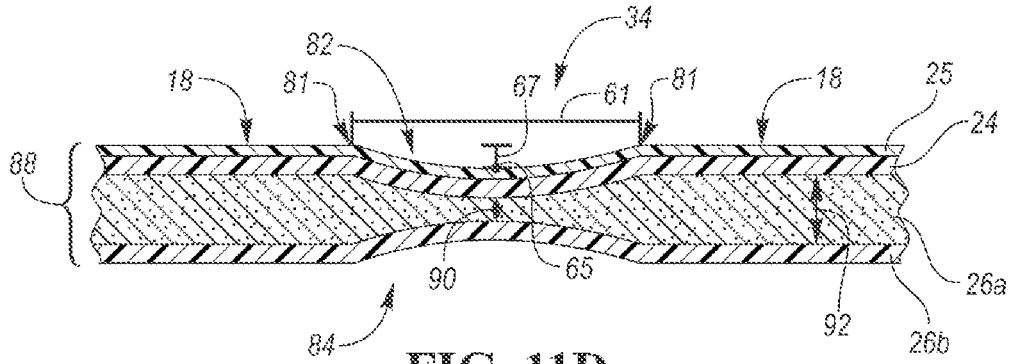
FIG. 11D is an enlarged, schematic, example cross sectional view of an example indentation, wherein the indentation is defined as a channel.

Referring to FIG. 11D, indentations 82 and 84, as well as the outer cover layer 24 and the second intermediate layer 26*b*, may be spaced from each other, such that a portion of the first intermediate layer 26*a* extends between indentations 82 and 84 and between the outer cover layer 24 and the second intermediate layer 26*b*. In this configuration, the outer cover layer 24 is bonded to the first intermediate layer 26*a* at the channel 34. In such an example, the first intermediate layer 26*a* has a first thickness 90 between indentations 82 and 84 and at the terminus 65 of the exterior indentation 82. In the same example, the first intermediate layer 26*a* has a second thickness 92 between the outer cover layer 24 and the second intermediate layer 26*b*, in an area spaced apart from indentations 82 and 84 and the terminus 65 of the exterior indentation 82. As shown in FIG. 11D, the first thickness 90 is less than the second thickness 92.

Figure 11E:
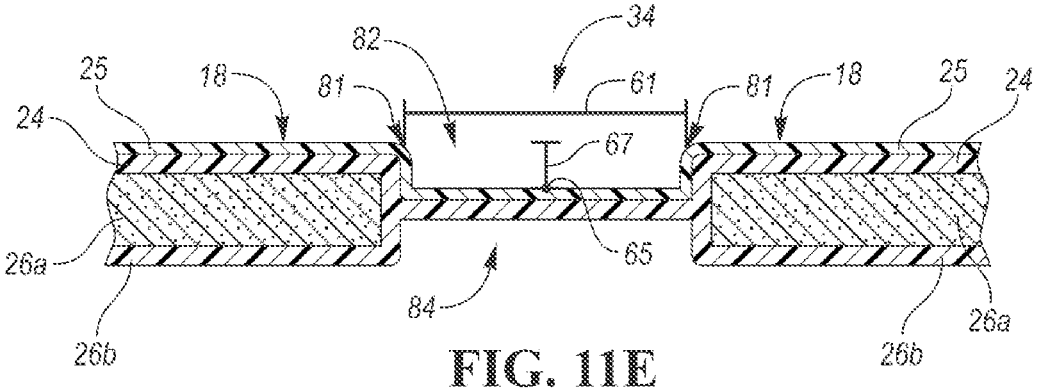
FIG. 11E is an enlarged, schematic, example cross sectional view of an example indentation, wherein the indentation is defined as a channel.
Figure 11F:
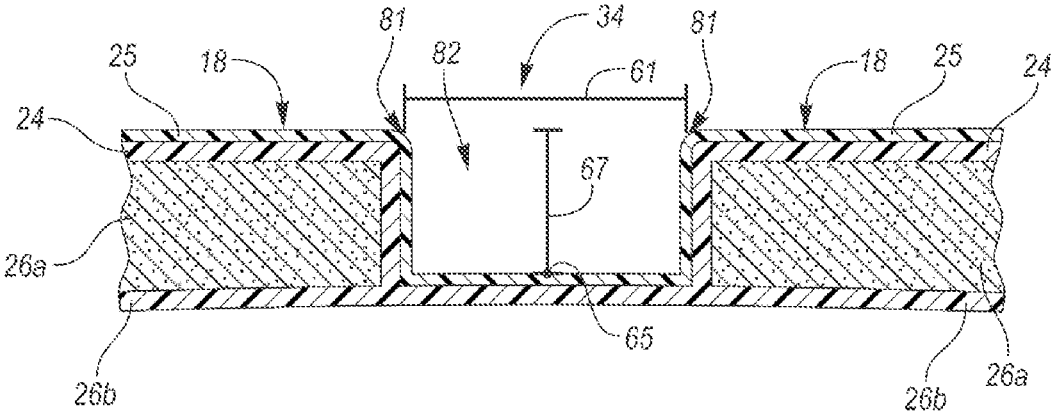
FIG. 11F is an enlarged, schematic, example cross sectional view of an example indentation, wherein the indentation is defined as a channel.
Figure 11G:
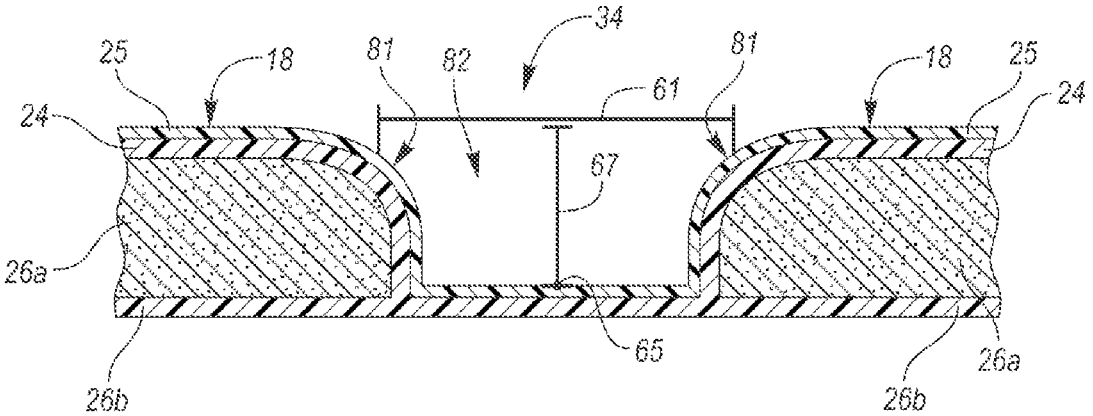
FIG. 11G is an enlarged, schematic, example cross sectional view of an example indentation, wherein the indentation is defined as a channel.

Alternatively, the channels 34 may include an exterior indentation 82 and an interior indentation 84 that exhibit substantially squared configurations (FIGS. 11E-11G). For example, in some embodiments, the indentations 82, 84 may have substantially squared cross-sectional configurations. Such substantially squared cross-sectional configurations may have a more distinct appearance than indentations 82, 84 having substantially rounded cross-sectional configurations. In addition, substantially squared indentations 82, 84 may also provide performance benefits such as aerodynamics, ball feel, and water channeling.

As shown in FIGS. 11E-11F, the exterior indentation 82 and interior indentation 84 are two opposing indentations having substantially squared cross-sectional configurations. In FIG. 11E, the indentations 82 and 84 extend to an approximate midpoint of the thickness 88 of the panel cross-section, such that the terminus 65 of the exterior indentation 82 is positioned radially inward from the outer cover layer surface 18 to the approximate midpoint of the thickness 88 of the panel cross-section.

In FIGS. 11F-11G, the exterior indentation 82 may extend through substantially the entirety of the thickness 88 of the panel cross section. As also shown in FIG. 11F-11G, in some embodiments, second intermediate layer 26*b* may have a substantially planar configuration opposite the exterior indentation 82. Said another way, in some embodiments, the channel 34 may have only an exterior indentation 82 with no interior indentation 84.

As shown in FIG. 11G, in one example embodiment, the channel 34 may include substantially-squared exterior indentation 82 having a rounded shoulder portion 81. In some embodiments, a substantially-squared shoulder portion 81 may have a minimal radius, as shown in FIG. 11F. In another example embodiment, a rounded shoulder portion 81 having a larger radius may be used, as shown in FIG. 11G.

Figure 7E:
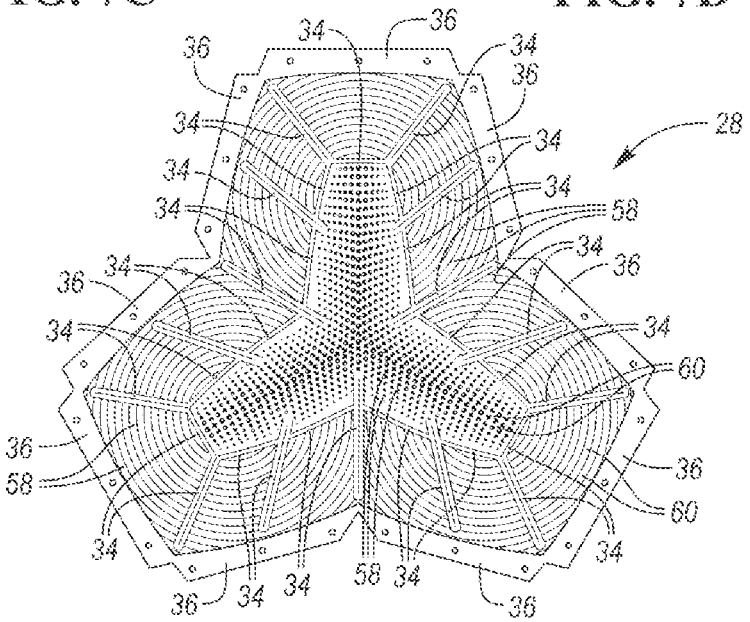
FIG. 7E is an example schematic plan view of an example panel having surface features formed thereon.

Referring to FIGS. 7E and 10 the plurality of surface features may further include a plurality of protrusions 58. The plurality of protrusions 58 may be disposed upon the outer cover layer surface 18. The protrusions 58 may form decorative or aesthetic arrangements or designs upon the outer cover layer surface 18 of the sports ball 10, display branding of the sports ball 10, via a logo contained therein, and may further be applied in such an orientation as to optimize grip at the point of contact with the user's hand and/or foot, or to improve aerodynamics during flight.

The protrusions 58 may be disposed on a small portion of the outer cover layer surface 18, on a single panel surface, on a select group of panel surfaces, or upon a majority of the outer cover layer surface 18 (FIG. 7E).

Each of the protrusions 58 may be formed of a dimensional ink and extend from the outer cover layer surface 18. As shown in FIG. 10, each of the plurality of the protrusions 58 has a terminus 62 that is radially spaced apart from the outer cover layer surface 18 by a height 64 that is greater than about 0.05 millimeters (mm). In such examples, it is beneficial for the height 64 to be at least 0.05 millimeters (mm) and less than 0.15 millimeters (mm) in order to enhance playability of the ball 10. As evaluated via qualitative assessment based on visual observations, protrusions 58 having heights 64 in the aforementioned range allow for visibility of the respective panel designs and an overall topographical arrangement of the sports ball 10, while also exhibiting a desired grip or contact between a user and/or player's hand or foot and the exterior surface 13 of the ball 10, all while still allowing the ball 10 to maintain desired aerodynamic and flight characteristics.

As shown in FIG. 8, the casing 12 may further include an external surface layer 25 disposed upon the outer cover layer surface 18. The external surface layer 25 may be a film that includes a pigment or a graphic thereon. The external surface layer 25 may also be an outer film or clear coat having weather resistant properties. The external surface layer 25 may be a polyurethane film or the like. The external surface layer 25 may be bonded to the outer cover layer surface 18 via a bonding material.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

What is claimed is:

1. An inflatable sports ball comprising:

a bladder capable of being inflated to a predetermined internal pressure, the bladder defining:

an exterior bladder surface; and a valve opening configured to receive a valve, the valve configured to permit selective inflation of the bladder to the predetermined internal pressure, such that the bladder defines a bladder circumference, when the bladder is inflated to the predetermined internal pressure;

a casing disposed about the bladder, the casing comprising:

an outer cover layer comprising:

a plurality of adjoining panels coupled at a plurality of seams, wherein each seam has a seam width and a seam depth;

a plurality of channels defined by the outer cover layer and spaced apart from each of the seams, each channel having a channel width and a channel depth; and a plurality of protrusions extending from the outer cover layer surface to a protrusion terminus, wherein the protrusion terminus is radially spaced apart from the outer cover layer surface by a protrusion height that is greater than about 0.05 millimeters (mm);

an intermediate structure disposed between the bladder and the outer cover layer, the intermediate structure comprising a restriction structure, wherein the restriction structure comprises a plurality of overlapping strips and the outer cover layer is bonded directly to the intermediate structure at each channel; and wherein:

each strip of the plurality of overlapping strips is interwoven with each of the other strips and wrapped about the bladder circumference;

the restriction structure comprises a uniform number of radially-stacked layers of the overlapping strips over a substantial entirety of the exterior bladder surface; and the plurality of overlapping strips defines a nexus void that is aligned with the valve opening such that the valve is contained within the nexus void.

2. The inflatable sports ball of claim 1 wherein the inflatable sports ball has an interior center disposed on a central axis, and wherein each of the nexus void, the valve opening, and the valve are positioned on the central axis, the inflatable sports ball further comprising:

a counterweight positioned on the central axis diametrically opposite the valve, the valve opening, and the nexus void when the bladder is inflated to the predetermined internal pressure; and wherein the counterweight includes at least one of a foam patch or a textile patch.

3. The inflatable sports ball of claim 1, wherein the intermediate structure further comprises:

a first intermediate layer;

a second intermediate layer disposed between the first intermediate layer and the restriction structure, wherein the first intermediate layer is disposed between the second intermediate layer and the outer cover layer; and wherein at least one of the first intermediate layer or the second intermediate layer comprises a Thermoplastic Polyurethane (TPU) foam material;

wherein the outer cover layer is bonded directly to the second intermediate layer at each channel.

4. The inflatable sports ball of claim 3 wherein:

each of the overlapping strips comprises an elastomeric material, such that the plurality of overlapping strips is a plurality overlapping elastomeric strips;

the first intermediate layer comprises a Thermoplastic Polyurethane (TPU) foam material; and the second intermediate layer comprises a winding layer comprising a textile filament repeatedly wound about and covering a substantial entirety of the restriction structure.

5. The inflatable sports ball of claim 3 wherein each of the overlapping strips comprises a textile material, such that the plurality of overlapping strips is a plurality of overlapping textile strips.

6. The inflatable sports ball of claim 5 wherein the textile material is impregnated with a thermoplastic material.

7. The inflatable sports ball of claim 3 wherein each of the overlapping strips further comprises:

a first end and a second end opposite the first end;

a length measured from the first end to the second end;

a first edge and a second edge positioned opposite the first edge, each of the first edge and the second edge extending from the first end to the second end;

a width measured from the first edge to the second edge; and wherein the first edge is substantially parallel to the second edge.

8. The inflatable sports ball of claim 7 wherein each strip defines an aspect ratio of the length to the width of from about 1:1 to about 15:1.

9. The inflatable sports ball of claim 8 wherein each strip defines the aspect ratio of the length to the width of greater than 8:1.

10. An inflatable sports ball comprising:

a bladder capable of being inflated to a predetermined internal pressure, the bladder defining:

an exterior bladder surface; and a valve opening configured to receive a valve, the valve configured to permit selective inflation of the bladder to the predetermined internal pressure, such that the bladder defines a bladder circumference, when the bladder is inflated to the redetermined internal pressure;

a casing disposed about the bladder, the casing comprising:

an outer cover layer;

an intermediate structure disposed between the bladder and the outer cover layer, the intermediate structure comprising a restriction structure comprising a plurality of overlapping strips, each strip of the plurality of strips comprising:

a first end and a second end opposite the first end;

a length measured from the first end to the second end;

a first edge and a second edge positioned opposite the first edge, each of the first edge and the second edge extending from the first end to the second end;

a width measured from the first edge to the second edge;

wherein the first edge is substantially parallel to the second edge;

an aspect ratio of the length to the width of from greater than about 8:1 to about 15:1;

the length of each of the strips is equal to the bladder circumference; and the first end of each of the strips is fixed to the second end of the respective strip such that each of the overlapping strips forms a restrictor ring about the bladder circumference, when the bladder is inflated to the predetermined internal pressure, such that the restriction structure is shaped to conform with the exterior bladder surface; and wherein:

each strip of the plurality of overlapping strips is interwoven with each of the other strips and wrapped about the bladder circumference;

the restriction structure comprises a uniform number of radially-stacked layers of the overlapping strips over a substantial entirety of the exterior bladder surface; and the plurality of overlapping strips defines a nexus void that is aligned with the valve opening such that the valve is contained within the nexus void.

11. The inflatable sports ball of claim 10 wherein the first edge is non-linear and the second edge is non-linear.

12. The inflatable sports ball of claim 11 wherein:

the first edge defines a first plurality of crests, a first plurality of depressions, and a first edge equilibrium;

each crest of the first plurality of crests extends to a crest terminus that is spaced apart from the first edge equilibrium in a first direction by a first edge crest height; and each depression of the first plurality of depressions extends to a depression terminus that is spaced apart from the first edge equilibrium in a second direction by a first edge depression depth; and the first direction is opposite the second direction.

13. The inflatable sports ball of claim 12 wherein:

the second edge defines a second plurality of crests, a second plurality of depressions, and a second edge equilibrium;

each crest of the second plurality of crests extends to a crest terminus that is spaced apart from the second edge equilibrium in the first direction by a second edge crest height; and each depression of the second plurality of depressions extends to a depression terminus that is spaced apart from the second edge equilibrium in the second direction by a second edge depression depth.

14. The inflatable sports ball of claim 13 wherein:

the first plurality of crests and the first plurality of depressions comprise an alternating and repeating series of crests and depressions, such that each crest is positioned between two depressions and each depression is positioned between two crests;

the second plurality of crests and the second plurality of depressions comprise an alternating and repeating series of crests and depressions, such that each crest is positioned between two depressions and each depression is positioned between two crests; and each crest of the first plurality of crests is aligned with one of the crests of the second plurality of crests and each depression of the first plurality of depressions is aligned with one of the depressions from the second plurality of depressions.

15. The inflatable sports ball of claim 14 wherein:

the first edge crest height is equal to the first edge depression depth;

the second edge crest height is equal to the second edge depression depth;

the first edge crest height is equal to the second edge crest height; and the first edge depression depth is equal to the second edge depression depth.

16. The inflatable sports ball of claim 15 wherein:

the aspect ratio of the length to the width of each of the respective strips is about 10:1;

a ratio of the first edge crest height to the width of the respective strip is about 1:8;

a ratio of the second edge crest height to the width of the respective strip is about 1:8;

a ratio of the first edge depression depth to the width of the respective strip is about 1:8; and a ratio of the second edge depression depth to the width of the respective strip is about 1:8.

17. The inflatable sports ball of claim 16 wherein:

the plurality of interwoven strips comprises six strips consisting of a first strip, a second strip, a third strip, a fourth strip, a fifth strip, and a sixth strip; and the uniform number of radially-stacked layers comprises two layers consisting of a first layer and a second layer.

* * * * *